US010718037B2

(12) United States Patent
Hata et al.

(10) Patent No.: US 10,718,037 B2
(45) Date of Patent: Jul. 21, 2020

(54) COPPER ALLOY MATERIAL AND PRODUCTION METHOD THEREFOR

(71) Applicant: Hitachi Metals, Ltd., Tokyo (JP)

(72) Inventors: Shohei Hata, Mito (JP); Takayuki Tsuji, Kitaibaraki (JP); Hiromitsu Kuroda, Hitachi (JP); Keisuke Fujito, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 886 days.

(21) Appl. No.: 15/052,657

(22) Filed: Feb. 24, 2016

(65) Prior Publication Data

US 2017/0016090 A1 Jan. 19, 2017

(30) Foreign Application Priority Data

Jul. 13, 2015 (JP) ..... 2015-139769

(51) Int. Cl.

| | |
|---|---|
| ***C22C 9/00*** | (2006.01) |
| ***C22C 1/02*** | (2006.01) |
| ***C22F 1/08*** | (2006.01) |
| ***B22D 11/00*** | (2006.01) |

(52) U.S. Cl.

CPC ..... *C22C 9/00* (2013.01); *B22D 11/004* (2013.01); *C22C 1/02* (2013.01); *C22F 1/08* (2013.01)

(58) Field of Classification Search

CPC ..... C22C 9/00

See application file for complete search history.

(56) References Cited

U.S. PATENT DOCUMENTS

| | | | | |
|---|---|---|---|---|
| 6,264,764 | B1 * | 7/2001 | Kamf | C22C 9/04 148/433 |
| 2005/0161129 | A1 | 7/2005 | Aoyama et al. | |
| 2008/0190523 | A1 * | 8/2008 | Gao | C22C 9/06 148/682 |
| 2014/0205491 | A1 * | 7/2014 | Fujito | H01B 1/026 420/492 |

FOREIGN PATENT DOCUMENTS

| | | |
|---|---|---|
| CN | 101381823 | 3/2009 |
| JP | 2010-188362 A | 9/2010 |

OTHER PUBLICATIONS

A Chinese Office Action issued in corresponding Chinese Application No. 201610116176.2 dated Mar. 15, 2019.

* cited by examiner

*Primary Examiner* — Christopher S Kessler

(74) *Attorney, Agent, or Firm* — Roberts Calderon Safran & Cole P.C.

(57) ABSTRACT

A copper alloy material production method is provided. A copper raw material including not higher than 30 ppm by mass of oxygen is melted to form a molten copper. Not lower than 4 ppm by mass and not higher than 55 ppm by mass of titanium is added to the molten copper. After the adding of the titanium, not lower than 100 ppm by mass and not higher than 7000 ppm by mass of magnesium is added.

6 Claims, 2 Drawing Sheets

COPPER ALLOY MATERIAL AND PRODUCTION METHOD THEREFOR

The present application is based on Japanese patent application No. 2015-139769 filed on Jul. 13, 2015, the entire contents of which are incorporated herein by reference.

BACKGROUND OF THE INVENTION

1. Field of the Invention

This invention relates to a copper alloy material and a method for producing the same.

2. Description of the Related Art

As a material for constituting conductors of equipment cables or contact wires for feeding rail vehicles, a copper material is used. This copper material is required to have not only a high electrical conductivity, but also a high mechanical strength from the point of view of bending properties and wear resistance.

In view of the foregoing, as a copper material for contact wires, a copper alloy material which is produced by alloying copper (Cu) with magnesium (Mg) for example is used. The copper alloy material including the magnesium is superior in mechanical strength as well as electrical conductivity because of solid solution strengthening resulting from the magnesium forming a solid solution in a copper parent phase.

The copper alloy material including the magnesium is produced by, for example, melting a copper parent material into a molten copper, thereafter adding, fusing magnesium to the molten copper, and casting a molten copper alloy including the magnesium. In general, copper alloy materials are produced in the form of long wire rods by a continuous process throughout from casting to rolling using an SCR (Southwire Continuous Rod) system, etc.

Because magnesium is an easily oxidizable metal element, the production of the copper alloy material has the following drawback: The easily oxidizable magnesium, when added to the molten copper, is oxidized due to oxygen that is included in the molten copper to form a magnesium oxide (e.g. MgO). The magnesium oxide remains solid without being fused to the molten copper because of its higher melting point than the molten copper temperature. In other words, some of the magnesium added remains in the form of its oxide without being fused to the molten copper. As a result, the copper alloy material produced by the casting contains a smaller amount of solid solution of the magnesium formed in the copper parent phase than the additive amount of the magnesium added when produced, and no sufficient solid solution strengthening by the magnesium results. In this manner, since some of the magnesium is not fused to the molten copper due to being oxidized, its addition yield is low and no desired solid solution strengthening is likely to result.

In view of the foregoing, as a method for suppressing the oxidation of the magnesium to be added to the molten copper, JP Patent No. 5515313 for example has suggested a method by deoxidizing the molten copper before adding the magnesium to the molten copper. Specifically, the oxygen amount included in the molten copper is reduced by deoxidization to not larger than 10 ppm, followed by adding the magnesium to the molten copper. This allows the fusion of the magnesium to the molten copper while suppressing the oxidation of the magnesium in the molten copper. Please see e.g. JP Patent No. 5515313.

SUMMARY OF THE INVENTION

However, while, by suppressing the oxidation of the magnesium to enhance the magnesium addition yield, the method disclosed by JP Patent No. 5515313 has been able to produce a copper alloy material superior in mechanical strength and electrical conductivity, this copper alloy material has tended to crack when subject to rolling such as hot rolling, etc.

In view of the foregoing problem, it is an object of the present invention to provide a copper alloy material, which is superior in mechanical strength and electrical conductivity, and which is unlikely to be cracked by rolling, and a copper alloy material production method by suppressing the oxidation of magnesium to produce a copper alloy material at a high addition yield.

(1) According to an aspect of one embodiment of the invention, a copper alloy material production method comprises:

melting a copper raw material including not higher than 30 ppm by mass of oxygen to form a molten copper;

adding not lower than 4 ppm by mass and not higher than 55 ppm by mass of titanium to the molten copper; and after the adding of the titanium, adding not lower than 100 ppm by mass and not higher than 7000 ppm by mass of magnesium.

In the one embodiment, the following modifications and changes may be made.

(i) In the adding of the titanium, the titanium not less than the content of the oxygen included in the molten copper is added.

(ii) In the adding of the titanium, the titanium is added in such a manner that a ratio of the titanium to the oxygen included in the molten copper is 1:1 to 8:1.

(iii) The copper alloy material production method further comprises:

continuously casting the molten copper with the magnesium added thereto to produce a cast material; and continuously hot rolling the cast material, wherein in the continuous rolling, the cast material is hot rolled at a temperature of the cast material of not lower than 400 degrees Celsius, and at a reduction in area of not lower than 80 percent and not higher than 99 percent.

(iv) The copper alloy material production method further comprises:

before the adding of the magnesium, removing an oxide of the titanium formed in the adding of the titanium.

(v) In the removing of the oxide, an inert gas is bubbled into the molten copper.

(2) According to an aspect of another embodiment of the invention, a copper alloy material consisting of:

not higher than 30 ppm by mass of oxygen;

not lower than 4 ppm by mass and not higher than 55 ppm by mass of titanium;

not lower than 100 ppm by mass and not higher than 7000 ppm by mass of magnesium; and the balance consisting of copper and inevitable impurities, wherein a titanium oxide is dispersed in a copper parent phase, while the magnesium forms a solid solution in the copper parent phase.

Points of the Invention

The present invention provides the copper alloy material, superior in mechanical strength and electrical conductivity, and unlikely to be cracked by rolling.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
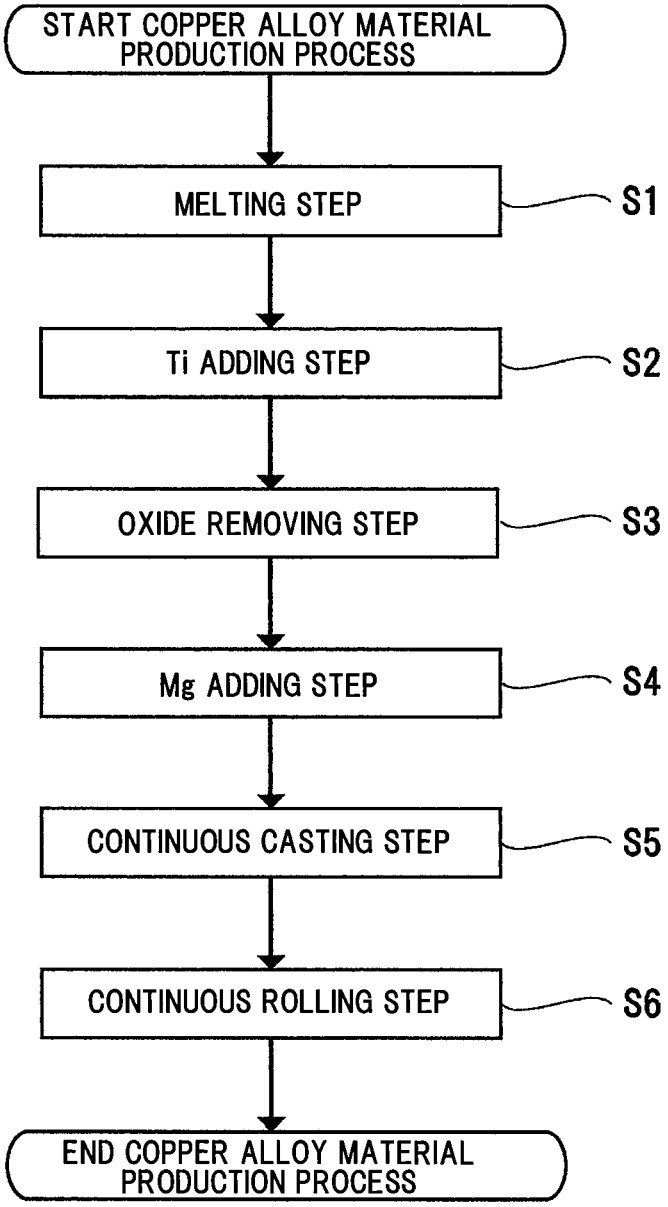
FIG. 1 is a process chart showing a copper alloy material production method in one exemplary embodiment of the present invention.

The present inventors have studied the above problem, and found out that a copper alloy material tends to crack during rolling for the following reason. That is, with the method by deoxidization of molten copper, although the oxidation of magnesium can be suppressed by reducing the content of oxygen present in the molten copper to not higher than 10 ppm by mass, because the oxygen cannot completely be removed, some of the magnesium added is oxidized to form a magnesium oxide. The magnesium oxide is not fused to the molten copper due to its high melting point, but is suspended on the surface of the molten copper due to its density smaller than copper density, and is flocculated to form an oxide aggregate (slag). The slag is precipitated and included as foreign matter in the copper alloy material to be cast. Because the slag due to the magnesium is hard to deform due to its high melting point, the copper alloy material with the slag present therein, when subjected to hot rolling, is cracked by the slag.

In this manner the presence of even a small amount of oxygen in the molten copper causes oxidization when magnesium is added. The present inventors have studied, as an alternative to deoxidization, a method to suppress the oxidation of magnesium due to the oxygen present in the molten copper. The present inventors have first paid attention to a method by adding a metal element other than magnesium to the molten copper, being followed by magnesium addition. This method reacts the oxygen present in the molten copper with a metal element other than magnesium to precipitate an oxide of that metal, thereby being able to reduce the content of the oxygen present in the molten copper, and subsequently adds magnesium to the molten copper having the lessened oxygen content, thereby being able to fuse the magnesium without causing the oxidation of the magnesium.

Further, from the fact that slag formation tends to be caused when the metal element to be added to the molten copper is as low in density as magnesium, it has been found that titanium (Ti), which is higher in density than magnesium and unlikely to be suspended on the surface of the molten copper, may be used as the metal element to be added to the molten copper. As with magnesium, titanium easily reacts with oxygen and can therefore greatly reduce the content of the oxygen in the molten copper, while titanium oxides are relatively high in density and can be finely dispersed without being suspended in the molten copper, and therefore are not likely to cause slag formation which can lead to loss in the quality of the copper alloy material.

Accordingly, the present invention is designed to add titanium to molten copper to thereby precipitate the oxygen dissolved in the molten copper as an oxide of titanium, and subsequently add magnesium, to thereby be able to fuse the magnesium to the molten copper without reducing the addition yield of the magnesium, and suppress magnesium slag formation. The present invention is based on the above findings.

Note that herein, the oxygen present in the molten copper refers to the oxygen, which is being dissolved in the molten copper as an impurity, and which is able to react with the magnesium to be added to the molten copper.

One Embodiment of the Present Invention

Figure 2:
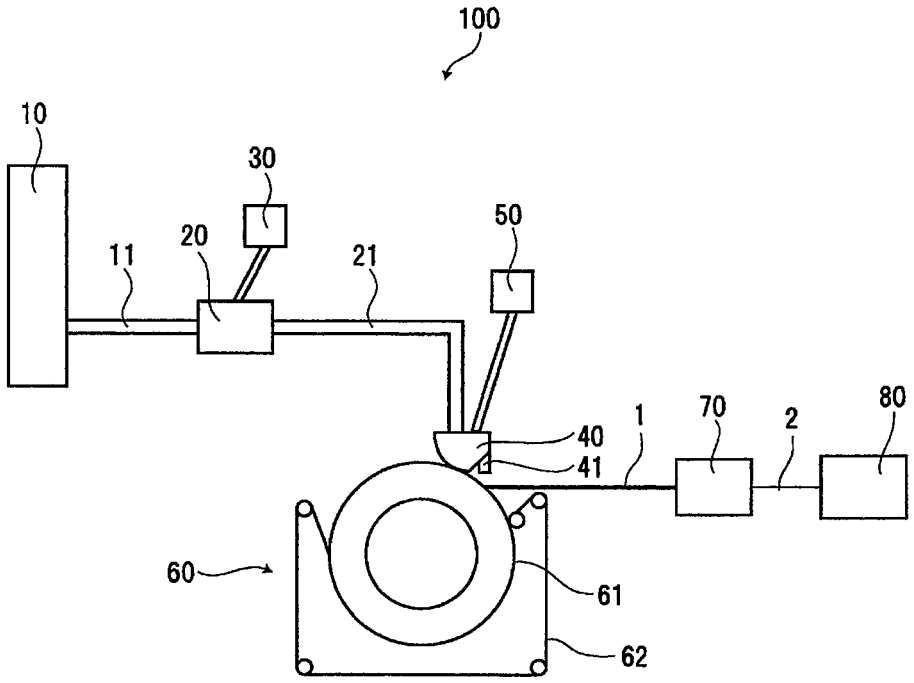
FIG. 2 is a schematic configuration diagram showing a continuous casting and rolling apparatus used in the copper alloy material production method in the one exemplary embodiment of the present invention.

Hereinafter, a copper alloy material production method in one exemplary embodiment of the present invention will be described with reference to the drawings. FIG. 1 is a process chart showing the copper alloy material production method in one exemplary embodiment of the present invention. FIG. 2 is a schematic view showing a continuous casting and rolling apparatus used in the copper alloy material production method in one exemplary embodiment of the present invention.

Continuous Casting and Rolling Equipment

Prior to the description of the copper alloy material production method, the continuous casting and rolling apparatus used in the production method will first be described. As shown in FIG. 2, a continuous casting and rolling apparatus 100 is composed of a smelting furnace 10, a retaining furnace 20, a titanium adding means 30, a tundish 40, a magnesium adding means 50, a belt wheel type continuous casting machine 60, a continuous rolling mill 70, and a coiler 80.

The smelting furnace 10 is designed to heat and melt a copper parent material to produce a molten copper. The smelting furnace 10 is composed of a furnace body (not shown) and a burner (not shown), which is provided in a lower portion of the furnace body, to heat and melt a copper parent material (e.g. electrolytic copper, or the like) fed into the furnace body in the burner, to continuously produce a molten copper.

An upstream runner 11 is designed to couple between the smelting furnace 10 and the retaining furnace 20 to transfer the molten copper produced in the smelting furnace 10 to the downstream retaining furnace 20.

The retaining furnace 20 is designed to retain the molten copper provided from the upstream runner 11 at a predetermined temperature, and provide a constant amount of the molten copper to the downstream runner 21. To the retaining furnace 20 is connected the titanium adding means 30, and the retaining furnace 20 is configured in such a manner that the titanium content in the molten copper within the retaining furnace 20 is a predetermined value by continuously adding titanium.

The downstream runner 21 is designed to couple between the retaining furnace 20 and the tundish 40 to transfer the molten copper from the retaining furnace 20 to the downstream tundish 40.

The tundish 40 is a reservoir which is provided to continuously feed the molten copper to the belt wheel type continuous casting machine 60. To the tundish 40 is connected the magnesium adding means 50, and the tundish 40 is configured in such a manner that the magnesium content in the molten copper within the tundish 40 is a predetermined value by continuously adding magnesium. This tundish 40 is provided with a pouring nozzle 41 on its termination side in a molten copper flowing direction, so that the molten copper in the tundish 40 is fed through the pouring nozzle 41 to the belt wheel type continuous casting machine 60.

The belt wheel type continuous casting machine 60 is composed of a wheel 61, which is formed with a groove (not shown) around an outer circumferential surface, and a belt 62, which rotates in such a manner as to come into contact with a part of the outer circumferential surface of the wheel 61. In the belt wheel type continuous casting machine 60, the molten copper is poured through the pouring nozzle 41 into a space formed between the groove of the wheel 61 and the belt 62. The wheel 61 and the belt 62 are cooled by cold water for example, to thereby cool and solidify the molten copper to continuously cast into a cast material 1 in the shape of a rod.

The continuous rolling mill 70 is provided on the downstream side of the belt wheel type continuous casting machine 60, to continuously roll the rod-shaped cast material 1 provided from the belt wheel type continuous casting machine 60, to mold into a copper alloy wire 2 having a predetermined diameter. The copper alloy wire 2 is wound around the coiler 80 provided downstream of the continuous rolling mill 70.

Copper Alloy Material Production Method

Following that, the above described method for producing the copper alloy material using the above described continuous casting and rolling apparatus 100 is described. Herein, the copper alloy material refers to a copper material constituting, for example, a copper alloy wire or the like, and the copper alloy wire refers to, for example, rough stock (a so-called wire rod), a conductor produced by rough stock or wire rod drawing or rolling, and subsequent annealing, and which is used in an electric wire, or the like. Hereinafter, the copper alloy wire made of the copper alloy material will be described taking the case of rough stock or wire rod production as an example.

Melting Step S1

First, in melting step S1 shown in FIG. 1, an electrolytic copper is fed into the smelting furnace 10 as a copper raw material, heated and melted to thereby form a molten copper.

As the copper raw material, it is possible to use a copper including not higher than 30 ppm by mass of oxygen. Because if the content of the oxygen in the copper raw material is higher than 30 ppm by mass, the oxygen included in the molten copper excessively increases, large amounts of oxides are formed in titanium adding step S2 or magnesium adding step S4 to be described later, leading to significant loss in the quality of the finished copper alloy wire 2. On the other hand, the lower limit of the content of the oxygen included in the copper raw material is not particularly limited, but in the case of general electrolytic copper, it is 10 ppm by mass. Incidentally, copper raw materials such as electrolytic copper, etc. contain inevitable impurities such as sulfur, etc. at the time of production thereof, and, for example, contain sulfur in a range of 3 ppm by mass to 12 ppm by mass.

Titanium Adding Step S2

Following melting step S1, the molten copper produced in the smelting furnace 10 is transferred through the upstream runner 11 to the retaining furnace 20 and retained therein. The titanium adding means 30 continuously adds titanium to the molten copper retained in the retaining furnace 20. This results in a reaction between the titanium and the oxygen present in the molten copper to form a titanium oxide. The titanium oxide has a melting point of 1870 degrees Celsius higher than the temperature of the molten copper (i.e. copper fusion temperature, e.g. on the order of 1100 degrees Celsius), and is therefore precipitated in the molten copper in a solid state. That is, in titanium adding step S2, the oxygen present in the molten copper is reacted with the titanium to be precipitated in the form of the titanium oxide, to thereby reduce the content of the oxygen present in the molten copper.

Moreover, the titanium oxide is high in density in comparison with the magnesium oxide, and therefore is easily dispersed in the molten copper without rapidly floating in the molten copper and flocculating, unlike the magnesium oxide. Specifically, the density of titanium is 4.11 g/cm$^3$ and is lower than the density (8.94 g/cm$^3$) of copper, but is not as low as the density (1.74 g/cm$^3$) of magnesium, therefore the titanium oxide is easily dispersed in the molten copper. For this reason, the titanium oxide allows the suppression of the slag formation due to flocculation, such as the magnesium oxide.

In this manner, in titanium adding step S2, the titanium is added to the molten copper to thereby reduce the amount of oxygen present in the molten copper, while the titanium oxide is dispersed in the molten copper to thereby be able to suppress the slag formation which can cause significant loss in the quality of the copper alloy wire 2. Consequently, titanium adding step S2 results in the molten copper with the reduced oxygen content, and with the titanium oxide finely dispersed therein.

In titanium adding step S2, the titanium is added in such a manner that the content of the titanium in the molten copper is not lower than 4 ppm by mass and not higher than 55 ppm by mass. If the content of the titanium is lower than 4 ppm by mass, it is difficult to reduce the amount of oxygen included in the molten copper, and when adding magnesium, it is not possible to sufficiently suppress the oxidation of the magnesium. On the other hand, if the content of the titanium is higher than 55 ppm by mass, the solid solubility limit of titanium is likely to be exceeded, and the titanium is likely to be precipitated in the finished copper alloy wire 2.

In titanium adding step S2, the content of the titanium may be within the above range, but from the point of view of reducing the oxygen in the molten copper, it is preferable to add the titanium in such a manner that the content of the titanium in the molten copper is not lower than the oxygen content in the molten copper. Specifically, it is more preferable to add the titanium in such a manner that the ratio of the titanium to the oxygen is 1:1 to 8:1. This makes it possible to reduce the amount of the oxygen included in the molten copper, and at the time of addition of magnesium to the molten copper, thereby further suppress the oxidation of the magnesium.

The method for adding the titanium is not particularly limited, but may be wire injection which is titanium wire feeding to the molten copper. The melting point of titanium itself is 1668 degrees Celsius and is higher than the temperature of the molten copper, but since the titanium wire when brought into contact with the molten copper is alloyed in such a manner as to have its melting point lower than the temperature of the molten copper, the titanium wire can gradually be fused to the molten copper. Then, by appropriately altering the diameter of the titanium wire, the speed for the titanium wire to be fused to the molten copper is adjusted, thereby allowing the titanium to be fed into the molten copper as well as onto the surface of the molten copper.

Note that although the molten copper contains inevitable impurities such as sulfur, etc. as well as the oxygen, these components are considered to react with the titanium oxide to form compounds.

Oxide Removing Step S3

Following titanium adding step S2, the above described titanium oxide produced in titanium adding step S2 is removed from the copper molten with the titanium added thereto. Although the titanium oxide is being dispersed in the molten copper, some of the titanium oxide is being suspended on the surface of the molten copper. Since the amount of the suspended titanium oxide is small, there is no slag formation that can cause significant loss in the quality of the copper alloy wire 2, but the amounts of impurities included in the copper alloy wire 2 can be reduced by removing the suspended titanium oxide, so that the quality of the copper alloy wire 2 can be further enhanced.

In oxide removing step S3, from the point of view of the suitable removal of the titanium oxide, it is preferred to bubble an inert gas into the molten copper. The inert gas bubbling allows the titanium oxide dispersed in the molten copper to float to the surface of the molten copper, therefore more of the titanium oxide can be removed. The inert gas, as long as it is that not trapped in the molten copper, is not particularly limited, but, for example, argon (Ar) gas or the like can be used.

Magnesium Adding Step S4

Following oxide removing step S3, the molten copper with the titanium oxide removed therefrom is transferred from the retaining furnace 20 through the downstream runner 21 to the tundish 40. Magnesium is continuously added to the molten copper in the tundish 40 by the magnesium adding means 50. As described above, in the molten copper in the tundish 40, the content of the oxygen is being lowered by the prior addition of the titanium. This allows the magnesium when added to the molten copper to be fused to the molten copper while the oxidation of the magnesium is being suppressed. This makes it possible to suppress the creation of the magnesium oxide or its aggregate, and thereby produce the copper alloy material with lessened slag included therein. Moreover, the suppression of the oxidation of the magnesium allows the magnesium to be fused to the molten copper with no significant lowering in magnesium addition yield, for example at an addition yield of not lower than 70 percent. Note that the addition yield refers to the ratio of the amount of solid solution of magnesium forming a solid solution in the copper alloy material produced by casting the molten copper, per the additive amount of magnesium added to the molten copper.

In magnesium adding step S4, the magnesium is added in such a manner that the content of the magnesium in the molten copper is not lower than 100 ppm by mass and not higher than 7000 ppm by mass. If the content of the magnesium is lower than 100 ppm by mass, the magnesium forming a solid solution in the copper parent phase in the copper alloy wire 2 lessens, and no sufficient solid solution strengthening effect resulting from the magnesium is achieved. On the other hand, if the content of the magnesium is higher than 7000 ppm by mass, the solid solubility limit of magnesium is likely to be exceeded, and the magnesium is likely to be precipitated in the copper alloy wire 2.

The molten copper produced in magnesium adding step S4 has a specified composition comprising not higher than 30 ppm by mass of the oxygen, not lower than 4 ppm by mass and not higher than 55 ppm by mass of the titanium, not lower than 100 ppm by mass and not higher than 7000 ppm by mass of the magnesium, and the balance consisting of the copper and the inevitable impurities.

The method for adding the magnesium is not particularly limited, but may be wire injection, as with the method for adding titanium. Because magnesium is low in melting point and is easily melted, a wire made of magnesium may be fed in such a manner as to be dropped rapidly to the bottom of the molten copper. In addition, because magnesium is low in density and tends to be suspended on the surface of the molten copper, a composite wire made of a copper coated magnesium wire may be fed. The feeding of the composite wire can result in a higher density than the density of the magnesium wire, while allowing the composite wire to be hard to fuse to the molten copper, and thereby makes it possible to push the composite wire to the bottom of the molten copper. This allows the magnesium to be diffused throughout the molten copper as well as onto the surface of the molten copper, and can therefore homogenize the magnesium content in the molten copper.

Continuous Casting Step S5

The molten copper alloy having the specified composition with the titanium and the magnesium added thereto is fed through the pouring nozzle 41 provided in the tundish 40 into the belt wheel type continuous casting machine 60. The belt wheel type continuous casting machine 60 has the space substantially rectangular in cross section, for example, formed between the groove provided around the wheel 61 and the belt 62, so that the molten copper is poured into that space, and cooled, thereby resulting in continuous formation of the rod-shaped cast material 1 having the substantially rectangular cross section. This cast material 1 is constructed of the copper alloy having the specified composition, with the magnesium forming a solid solution in the copper parent phase, and with the titanium oxide finely dispersed and precipitated in the copper parent phase without its flocculation.

Continuous Rolling Step S6

The rod-shaped cast material 1 is introduced into the continuous rolling mill 70. In the continuous rolling mill 70, with the linear copper alloy wire 2 being produced by rolling the cast material 1, the resulting copper alloy wire 2 is wound around the coiler 80.

In continuous rolling step S6, it is preferable to hot roll the cast material 1, and more preferable to perform the hot rolling of the cast material 1 at a temperature of the cast material 1 of not lower than 400 degrees Celsius, and at a reduction in area of not lower than 80 percent and not higher than 99 percent. In this embodiment, in the copper alloy constituting the cast material 1, the titanium oxide, though present in the copper parent phase, is being finely dispersed, there being virtually no slag that can cause significant loss in quality, therefore no cracks being likely to form in the copper alloy wire 2, even when the copper alloy wire 2 is produced by hot rolling in the above conditions. The reduction in area refers to a ratio of a reduction in cross sectional area when the cast material 1 is drawn into the copper alloy wire 2. Note that when multiple rollings are performed, the reduction in area in each rolling may be adjusted so that the total reduction in area by the multiple rollings lies within the above range.

Configuration of the Copper Alloy Material

The copper alloy wire 2 produced by the production method described above is made of the specified copper alloy material, and the copper alloy material is consisted of not higher than 30 ppm by mass of the oxygen, not lower than 4 ppm by mass and not higher than 55 ppm by mass of the titanium, not lower than 100 ppm by mass and not higher than 7000 ppm by mass of the magnesium, and the balance consisting of the copper and the inevitable impurities. The copper alloy material is then produced by titanium addition to the molten copper and subsequent magnesium addition, and is thereby configured in such a manner that the titanium oxide resulting from the reaction between the oxygen present in the molten copper and the titanium is dispersed in the copper parent phase, while the magnesium forms a solid solution in the copper parent phase.

Since unlike the magnesium oxide, the titanium oxide is not floated and flocculated in the molten copper, the titanium oxide forms fine particles. The particle diameter of the fine particles of the titanium oxide is preferably not larger than 1 μm.

Since the copper alloy wire 2 made of the copper alloy material in the present embodiment is configured in such a manner that the predetermined amount of the magnesium forms a solid solution in the copper parent phase, the copper alloy wire 2 is superior in mechanical strength and electrical conductivity. Specifically, the mechanical strength of the copper alloy wire 2 is not lower than 240 MPa and not higher than 280 MPa for rough stock immediately after hot rolling in above described continuous rolling step S6. Further, the mechanical strength of the copper alloy wire 2 subsequently cold drawn is not lower than 440 MPa and not higher than 500 MPa. The electrical conductivity of the copper alloy wire 2 is 72 to 83 percent IACS. Moreover, because the copper alloy wire 2 is configured in such a manner that the titanium oxide, though present in the copper parent phase, is being finely dispersed without being flocculated therein, the copper alloy wire 2 is unlikely to crack when subject to rolling. For this reason, the copper alloy wire 2 is unlikely to crack even when hot rolled at a heating temperature of not lower than 400 degrees Celsius, and at a reduction in area of not lower than 80 percent and not higher than 99 percent, for example.

Advantageous Effects of the Present Embodiment

The present embodiment achieves one or more advantageous effects described below.

In the present embodiment, the copper alloy material is produced by the titanium addition prior to the addition of the magnesium to the molten copper. The titanium addition results in a reaction between the oxygen present in the molten copper with copper raw material molten therein and the titanium, thereby precipitating the oxygen in the form of the titanium oxide, to reduce the content of the oxygen present in the molten copper. Then, by the addition of the magnesium to the molten copper having the reduced oxygen content, the magnesium is fused to the molten copper while the oxidation of the magnesium is being suppressed. On the other hand, because the titanium oxide is relatively high in density, the titanium oxide can be finely dispersed in the molten copper with no slag formation due to flocculation, unlike the magnesium oxide. In this manner, casting the molten copper alloy with the magnesium fused thereto and with the titanium oxide finely dispersed therein results in the copper alloy material having the specified composition, and being configured in such a manner that the titanium oxide is dispersed in the copper parent phase, while the magnesium forms a solid solution in the copper parent phase.

In the present embodiment, since the content of the oxygen present in the molten copper can be reduced by the addition of the titanium to the molten copper, the magnesium can be fused to the molten copper without being oxidized, even when using a copper having a content of oxygen of not higher than 30 ppm by mass as the copper raw material.

In this embodiment, since the oxidation of the magnesium can be suppressed by the prior addition of the titanium, the magnesium can be fused at an addition yield of not lower than 70 percent.

In this embodiment, since the content of the oxygen present in the molten copper can be reduced by the addition of the titanium, no large-scale equipment for deoxidization is required.

In this embodiment, the titanium not less than the content of the oxygen included in the molten copper is added to the molten copper. This allows the titanium not less than the oxygen to be present in the molten copper, therefore the oxygen mixed in the production process for example can be precipitated in the form of the titanium oxide. For this reason, there is no need to seal the retaining furnace 20, the tundish 40, and the like.

In this embodiment, the titanium is added in such a manner that the ratio of the titanium to the oxygen is 1:1 to 8:1. This allows the oxygen present in the molten copper to tend to be precipitated in the form of the titanium oxide, thereby making it possible to further reduce the oxygen content.

In this embodiment, between the titanium adding step and the magnesium adding step, the step of removing the titanium oxide formed by the addition of the titanium is provided. This allows for reducing the titanium oxide to be precipitated in the molten copper, and thereby further enhancing the quality of the copper alloy material.

In the present embodiment, when the titanium oxide is removed, an inert gas is bubbled into the molten copper. This allows the titanium oxide be dispersed in the molten copper to be suspended on the surface of the molten copper, and thereby tend to be removed.

Since the copper alloy material in the present embodiment is configured in such a manner that the predetermined amount of the magnesium forms a solid solution in the copper parent phase, the copper alloy material is superior in mechanical strength and electrical conductivity. Specifically, the mechanical strength of the copper alloy material is not lower than 240 MPa and not higher than 280 MPa for rough stock immediately after hot rolling in above described continuous rolling step S6, and the mechanical strength of the copper alloy material subsequently cold drawn is not lower than 440 MPa and not higher than 500 MPa. The electrical conductivity of the copper alloy material is 72 to 83 percent IACS.

Because the copper alloy material in the present embodiment is configured in such a manner that the titanium oxide, though present in the copper parent phase, is being finely dispersed without being flocculated therein, the copper alloy material is unlikely to crack when subject to rolling. For this reason, the rough stock made of the copper alloy material can be prevented from cracking, when worked into a conductor, and even when hot rolled at a temperature of not lower than 400 degrees Celsius, and at a reduction in area of not lower than 80 percent and not higher than 99 percent, for example.

Other Embodiments of the Present Invention

Although the embodiment of the present invention has been described above, the invention is not limited thereto, but alterations may appropriately be made without departing from the technical idea of the invention.

Although in the above embodiment it has been described that the copper alloy wire 2 is produced continuously by continuous casting and rolling, the present invention is not limited thereto, but the copper alloy wire 2 may be produced by, for example, after magnesium adding step S4, forming the copper alloy material in the form of an ingot, extruding and cold working that ingot.

Further, although in the above embodiment it has been described that the copper alloy wire 2 is produced by using the continuous casting and rolling apparatus 100 with the belt wheel type continuous casting machine 60, the invention is not limited thereto, but as the continuous casting machine, a twin belt continuous casting machine composed of a belt and a belt for example may be used.

Also, although in the above embodiment it has been described that the titanium is added to the retaining furnace 20 by the titanium adding means 30 and the magnesium is added to the tundish 40 by the magnesium adding means 50, the invention is not limited thereto. As long as the invention is configured in such a manner that the titanium adding means 30 is provided on the upstream side relative to the magnesium adding means 50, the invention is not particularly limited, but the titanium adding means 30 and the magnesium adding means 50 may be provided for the smelting furnace 10, the upstream runner 11, the retaining furnace 20, the downstream runner 21 and the tundish 40. Also, for the magnesium adding means 50, since magnesium tends to be fused at a low melting point, the magnesium adding means 50 may be provided so as to pour the magnesium directly into the pouring portion of the belt wheel type continuous casting machine 60, i.e. the space formed between the groove of the wheel 61 and the belt 62.

EXAMPLES

Next, examples of the present invention will be described.

Example 1

A copper alloy material was produced using the continuous casting and rolling apparatus as shown in FIG. 2.

First, an electrolytic copper was fed into the smelting furnace 10 as a copper raw material, and a molten copper was formed by heating and melting. At this point, for a reducing character, by adjusting the air-fuel ratio of a gas burner, the oxygen concentration in the molten copper was reduced to 20 ppm by mass. Subsequently, the molten copper was transferred from the smelting furnace 10 through the upstream runner 11 to the retaining furnace 20 and retained therein. At the retaining furnace 20, titanium was continuously added to the molten copper by the titanium adding means 30 so that the titanium content was 30 ppm by mass. By the addition of the titanium, titanium oxide formation was identified immediately in the molten copper. It was observed that the titanium oxide was fine particles having a particle diameter of not larger than 1 μm, and was suspended or floated in the molten copper without being flocculated in the molten copper. Subsequently, the suspended titanium oxide was appropriately skimmed off the molten copper with the titanium added thereto, and its molten copper was transferred from the retaining furnace 20 through the downstream runner 21 to the tundish 40. At the tundish 40, magnesium was added in a concentration range of 100 ppm by mass to 7000 ppm by mass by the magnesium adding means 50 and was fused. At this point, no large slag formation caused by the creation of the magnesium oxide was identified. A cast material 1 was then produced by feeding the magnesium including molten copper through the pouring nozzle 41 into the belt wheel type continuous casting machine 60 and casting. Finally, the cast material 1 was introduced into the continuous rolling mill 70 and rolled, thereby resulting in a linear copper alloy material.

For the resulting copper alloy material, by measurement of the addition yield of the magnesium, it was identified that the addition yield of the magnesium was not lower than 70 percent, and that not lower than 70 percent of the magnesium added was able to form a solid solution in the copper alloy material.

For the resulting copper alloy material, by measurement of mechanical strength (proof stress) and electrical conductivity, it was identified that the mechanical strength was 260 MPa, and the electrical conductivity was 80 percent IACS, for rough stock having a diameter of 30 mm immediately after hot rolling at a temperature of not lower than 400 degrees Celsius, and at a reduction in area of not lower than 80 percent and not higher than 99 percent. On the other hand, it was identified that when further cold drawing was performed, and strain was given in the same manner as when a contact wire having a diameter of about 18 mm was made, the mechanical strength was 450 MPa, and the electrical conductivity was 80 percent IACS. Moreover, since the copper alloy material included little slag, no cracks formed even when hot rolling was performed in the predetermined conditions.

Comparative Example 1

In Comparative Example 1, a copper alloy material was produced in the same manner as in Example 1, except that magnesium was added without titanium addition.

When the magnesium was added to a molten copper, it was observed that a magnesium oxide was created by oxidation of the magnesium, suspended on the surface of the molten copper, and flocculated, thereby resulting in 0.5 mm to 3 mm size slag formation. By measurement of the addition yield of the magnesium, it was identified that the addition yield of the magnesium was as low as 10 percent to 20 percent, that much of the magnesium was oxidized, and that the magnesium was unable to be fused to the molten copper and sufficiently form a solid solution in the copper parent phase. Also, when the copper alloy material in Comparative Example 1 was hot rolled in the same conditions as in Example 1, copper alloy material was cracked by the slag. It is supposed that copper alloy material was cracked because the copper alloy material included a large amount of slag.

Preferred Aspects of the Present Invention

Preferred aspects of the present invention are listed below.

Aspect 1

According to one aspect of the present invention, a copper alloy material production method includes:

melting a copper raw material including not higher than 30 ppm by mass of oxygen to form a molten copper;

adding not lower than 4 ppm by mass and not higher than 55 ppm by mass of titanium to the molten copper; and after the adding of the titanium, adding not lower than 100 ppm by mass and not higher than 7000 ppm by mass of magnesium.

Aspect 2

The copper alloy material production method according to aspect 1 above, wherein preferably in the adding of the titanium, the titanium not less than the content of the oxygen included in the molten copper is added.

Aspect 3

The copper alloy material production method according to aspect 1 or 2 above, wherein preferably in the adding of the titanium, the titanium is added in such a manner that a ratio of the titanium to the oxygen included in the molten copper is 1:1 to 8:1.

Aspect 4

The copper alloy material production method according to any one of aspects 1 to 3 above further comprises: preferably continuously casting the molten copper with the magnesium added thereto to produce a cast material;

continuously hot rolling the cast material, wherein in the continuous rolling, the cast material is hot rolled at a temperature of the cast material of not lower than 400 degrees Celsius, and at a reduction in area of not lower than 80 percent and not higher than 99 percent.

Aspect 5

The copper alloy material production method according to any one of aspects 1 to 4 above further comprises preferably before the adding of the magnesium, removing an oxide of the titanium formed in the adding of the titanium.

Aspect 6

The copper alloy material production method according to any one of aspects 1 to 5 above, wherein preferably in the removing of the oxide, an inert gas is bubbled into the molten copper.

Aspect 7

According to another aspect of the invention, a copper alloy material is consisted of:

not higher than 30 ppm by mass of oxygen;

not lower than 4 ppm by mass and not higher than 55 ppm by mass of titanium;

not lower than 100 ppm by mass and not higher than 7000 ppm by mass of magnesium; and the balance consisting of copper and inevitable impurities, wherein the copper alloy material is configured in such a manner that a titanium oxide is dispersed in a copper parent phase, while the magnesium forms a solid solution in the copper parent phase.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A copper alloy material production method, comprising:

melting a copper raw material including not higher than 30 ppm by mass of oxygen to form a molten copper;

reducing a content of the oxygen present in the molten copper, by adding not lower than 4 ppm by mass and not higher than 55 ppm by mass of titanium to the molten copper while the molten copper is retained in a retaining furnace, thereby reacting the oxygen present in the molten copper with the titanium to be precipitated in form of a titanium oxide; and after the adding of the titanium to the molten copper, adding not lower than 100 ppm by mass and not higher than 7000 ppm by mass of magnesium to the molten copper in which the content of the oxygen is reduced by the precipitation of the titanium oxide, thereby fusing the magnesium to the molten copper while suppressing an oxidation of the magnesium.

2. The copper alloy material production method according to claim 1, wherein in the adding of the titanium, the titanium not less than the content of the oxygen included in the molten copper is added.

3. The copper alloy material production method according to claim 1, wherein in the adding of the titanium, the titanium is added in such a manner that a ratio of the titanium to the oxygen included in the molten copper is 1:1 to 8:1.

4. The copper alloy material production method according to claim 1, further comprising:

continuously casting the molten copper with the magnesium added thereto to produce a cast material; and continuously hot rolling the cast material, wherein in the continuous rolling, the cast material is hot rolled at a temperature of the cast material of not lower than 400 degrees Celsius, and at a reduction in area of not lower than 80 percent and not higher than 99 percent.

5. The copper alloy material production method according to claim 1, further comprising:

before the adding of the magnesium, removing an oxide of the titanium formed in the adding of the titanium.

6. The copper alloy material production method according to claim 5, wherein in the removing of the oxide, an inert gas is bubbled into the molten copper.

* * * * *